United States Patent [19]

Bronder et al.

[11] Patent Number: 5,055,173

[45] Date of Patent: Oct. 8, 1991

[54] BATH FOR THE ELECTROLYTIC DEPOSITION OF FINE GOLD COATINGS

[75] Inventors: Klaus Bronder, Swäbisch Gmünd; Joachim Dietrich, Gelnhausen, both of Fed. Rep. of Germany

[73] Assignee: Degussa Aktiengesellschaft, Fed. Rep. of Germany

[21] Appl. No.: 483,220

[22] Filed: Feb. 22, 1990

[30] Foreign Application Priority Data

Feb. 24, 1989 [DE] Fed. Rep. of Germany ..... 3905705

[51] Int. Cl.[5] ..... C25D 3/48

[52] U.S. Cl. ..... 204/47.5; 204/44.3

[58] Field of Search ..... 204/44.3, 47.5

[56] References Cited

U.S. PATENT DOCUMENTS 4,517,060 5/1985 Dettke et al. ..... 204/44

OTHER PUBLICATIONS

J. D. E. McIntyre et al., J. Electrochem. Soc., vol. 123, No. 12, pp. 1800–1813, Dec. 1976.

*Primary Examiner*—John F. Niebling
*Assistant Examiner*—Steven P. Marquis
*Attorney, Agent, or Firm*—Cushman, Darby & Cushman

[57] ABSTRACT

Bondable fine gold coatings are obtained from electrolytic baths which contain 2 to 100 g/l gold as alkali or ammonium gold (I)-cyanide, 0.1 mg to 5 g/l of a soluble bismuth compound, 0 to 250 g/l of a phosphonic acid, its salts, esters or simple substitution products and/or 0 to 250 g/l phosphoric acid or its salts but at least 5 g/l of phosphoric acid compound or phosphonic acid compound, and which exhibit a pH of 6 to 10.

4 Claims, No Drawings

BATH FOR THE ELECTROLYTIC DEPOSITION OF FINE GOLD COATINGS

The present invention relates to a bath for the electrolytic deposition of bondable pure gold coatings which have a gold content above 99.9 % by weight. The bath according to the invention contains gold in the form of alkali or ammonium gold-(I)-cyanide as well as phosphonic acids and/or phosphoric acid or their salts or derivatives and a water-soluble bismuth compound.

BACKGROUND OF THE INVENTION

Electrolytic gold baths are used for many applications. They generally contain alkali or ammonium gold (I) cyanide or, less commonly, gold(III)-cyanides or alkali gold sulfites.

Gold baths for decorative applications almost always deposit gold alloys with considerable amounts of alloy metal to obtain desired color effects.

Gold baths also are used widely to obtain gold with good electric and mechanical properties for use in light-duty electric contacts. These baths operate in a weakly acidic pH range (pH 3–5). The coating contains usually small amounts (0.1–1%) of nickel, cobalt or iron in addition to gold.

Moreover, electrolytic gold baths are also used for the deposition of fine gold layers with a gold content of at least 99.9 %, e.g. as bondable coatings in semiconductor technology.

The term bonding techniques refers to those methods in which system carriers are connected in a conductive manner in microelectronics to electronic components, e.g. chips, via fine wires (consisting usually of gold or aluminum). The connection of the wire to a gilded connection surface takes place by means of pressure, elevated temperature and is frequently supported by ultrasonic energy.

The bonding connection is only successful if the gold coating on the connection surface is very pure (fine gold with a gold content of at least 99.9%), soft (maximum hardness 120 HV) and satin-finished. Hard, highly lustrous coatings are unsuitable. Further requirements for bondable gold layers result from the stressing from heat-stress tests which are carried out to assure a good bondability. Such heat-stress tests are carried out e.g. on an unbonded test piece. No discoloration of the gold layer is allowed to occur in these tests e.g. after heating for 5 minutes at 500° C. in air. In other tests, the bonded test piece is exposed to temperature-change tests or to a temperature of 150°–180° C. for many hours in air. These heat-stress tests bring about diffusion processes between the gold and the carrier material in the gold layer. The effect of such diffusion processes on the bond behavior is a function of the thickness of the layer of the gold and of its structure. Since it is required that the gold layer be as thin as possible, for economic reasons, the structure of the coating must be optimized by means of bath additives and the selection of suitable deposition conditions in such a manner that a minimum thickness of the gold layer assures acceptable bondability. Such bath additives have previously been known in the form of arsenic, thallium or lead.

A further criterion for the economy of a electrolytic method is the deposition speed of the bath, consistent with obtaining the desired properties in the gold layer. The deposition speed results from the usable current density, whose upper limit should be as high as possible without loss of the desired properties of the gold layers.

Simple possibilities for obtaining high, reliable current densities are the elevation of the gold content in the bath or a rapid electrolyte motion. On the other hand, because of the high price of gold, the economy of the method suffers if the gold contents are too high.

The use of apparatus (special electrolytic cells) which provide very high electrolyte motion by flowing the bath or spraying it against the material to be plated often also selectively limits the deposit of gold onto the functionally important surface elements of the item, by means of the use of masks. However, a strong flow through the electrolyte is important for the speed of deposition (maximum permissible current density).

In spite of the elevation of the deposition speed which can be achieved with these measures, a further increase of current density and of deposition speed by means of improving the composition of the gold baths is very desirable. Furthermore, increased requirements are placed on the stability of the electrolyte as a result from the high current density to be used (cathodic and especially also anodic) as well as from the strong turbulence of the baths in flow systems.

Published European Patent Application EP-OS 0 126 921 describes a bath for the electrolytic deposition of gold alloys which also contains between 10 mg and 100 g/l bismuth in the form of a water-soluble complex compound in addition to alkali gold (I)-cyanide and phosphonic acids. This bath, which operates in a pH range of 6 to 13, forms rose to violet-colored alloy coatings for decorative purposes with gold contents of 65 to 85% by weight which are totally unsuited for bonding applications.

Special gold layers are obtained from electrolytic baths containing hydrogen phosphates, phosphonic acids and nitrogenous carboxylic acids in addition to alkali gold (I)cyanide (Published German Patent Application DE-OS 35 37 283). Current densities up to 15 $A/dm^2$ can be obtained by this means in flow systems. However, dull brown coatings which are useless for bonding applications are obtained at normal bath motion at current densities as low as 1 $A/dm^2$.

U.S. Pat. No. 3,879,269 describes gold baths for the deposition of bondable fine gold coatings in high-speed cells. These baths contain a critical amount of 2–12 mg/l trivalent arsenic ions in addition to 24–40 g/l gold, phosphates and carboxylic acids. In spite of their use in a high-speed cell and in spite of a very high gold concentration, useful coatings are achieved only at current densities up to approximately 4 $A/dm^2$.

Electrolytic gold baths with trivalent arsenic as a grain-refining additive all suffer from the known phenomenon that the trivalent arsenic is oxidized to a pentavalent arsenic, which process occurs even when the bath is not used, but at an especially high reaction speed under the oxidative influences (high anodic current density, strong air flow) of high-speed electrolysis in flow or spray cells. Pentavalent arsenic exhibits no grain-refining or luster-forming effect. On the other hand, the required and acceptable concentration of trivalent arsenic is in a range of some mg/l. Since a sufficiently precise method of analysis for this active component is not available, a reliable bath control is not assured. The instability of the additive results in significant variations in quality which can be limited in an unpredictable manner only by means of frequent function tests and corrections.

Published German Patent Application DE-OS 33 41 233 relates to an acidic fine gold bath with an addition of 5 to 50 ppm (mg/l) lead which can be operated in a current density range of 0.5 to 2 A/dm$^2$. The optimal current density is 0.6 A/dm$^2$.

The use of thallium as a grain refiner in concentrations of 1–140 mg/l in gold baths with a pH in the range of 7–13 is described e.g. in Published German Patent Application DE-OS 21 31 815. The useful current density range is 0.1–20 A/dm$^2$.

It is known in the case of electrolytic gold baths containing lead or thallium as grain-refining additives that gold coatings deposited out of them are unobjectionably bondable in a freshly deposited state; however, they loose their resistance to rupture to a large extent in the subsequently performed heat tests of e.g. 150° C./ 24 hours, so that bond tearing occurs.

SUMMARY OF THE INVENTION

The object of the present invention is to provide a bath for the electrolytic deposition of bondable fine gold coatings with a gold content over 99.9% by weight containing gold as alkali or ammonium gold (I)-cyanide as well as phosphonic acids and/or phosphoric acids or their salts or derivatives and a water-soluble bismuth compound which can be used at a high useful current density with an unobjectionable stability of the bath and with which good bondability and thermal resistance can be achieved in the coatings.

These and other objects are achieved with a bath which contains 2 to 100 g/l gold, 0.1 mg to 5 g/l bismuth, 0 to 250 g/l phosphonic acid or its salts, esters, or simple substitution products and/or 0 to 250 g/l phosphoric acid or its salts, the sum of the contents of phosphonic acid compounds and phosphates being at least 5 g/l. The bath has a pH of 6 to 10.

The baths preferably contain phosphonic acids or their salts or esters which comprise at least two groups of the form —PO(OH)$_2$, which are attached to an aliphatic simple or branched hydrocarbon chain which can also be interrupted by one or more nitrogen atoms.

It is advantageous if the electrolytic gold baths contain 2 to 50 g/l gold as alkali or ammonium gold (I)-cyanide, 0 to 250 g/l alkali phosphates, alkali hydrogen phosphates or the corresponding ammonium salts, 5 to 250 g/l of a phosphonic acid in the form of 1-hydroxyethane-1,1-diphosphonic acid, amino-tri-methylene phosphonic acid, ethylene diamine-tetra-methylene phosphonic acid or their hexasodium salts and 0.5 mg to 4 g/l bismuth in the form of bismuth ammonium citrate.

Gold baths which have proven themselves especially useful contain 8 to 24 g/l gold, 40 to 150 g/l phosphate, 20 to 120 g/l phosphonic acid and 0.5 to 4000 mg/l bismuth.

In addition, polyphosphoric acids, superphosphates, amidopolyphosphates, pyrophosphates and supporting electrolytes, buffer substances, complexing agents or wetting agents which are conventionally used in electrolytic technology can also be contained in the baths.

The electrolytic gold baths of the invention make it possible to achieve a deposition of bondable fine gold coatings at a high current density and deposition speed. In the case of conventional substrate and bath motion, the operation can be performed at a current density up to 4 A/dm$^2$ and the deposition speed is up to approximately 2.50 μm/min. On high-speed cells (jet-plating cells) the permissible current density can be up to 25 A/dm$^2$ and deposition speeds up to 14.5 μm/min. can be achieved.

The gold coatings produced in this manner are very pure (fineness 99.99%), soft (hardness 70–120 HV), semilustrous and have excellent bondability. The bismuth content in the gold coating is below 50 ppm. The fine gold coatings exhibit an excellent stability to heat stresses both before and after bonding. Gold coatings 0.4 μm thick on a nickel base withstand the heat test of 5 minutes aging at 500° C. without discoloration. Bonded specimens exhibit no decline in tensile strength after 48 hours aging at 150° C. The weakening of the bond strength of the gold coatings observed in the case of additions of thallium and lead in the bath does not occur.

The baths are completely stable independently of the time of storage (without use) and independently of the duration of use.

The electrolytic gold baths of the invention preferably use phosphonic acids which contain at least 2 groups of the form —PO(OH)$_2$ which are attached to an aliphatic straight or branched hydrocarbon chain, which hydrocarbon chain can be interrupted by one or more nitrogen atoms. The members of the hydrocarbon chain can be substituted by NH$_2$-groups or OH-groups or other simple substituents.

An example of a simple, nitrogen-free phosphonic acid of the type cited with 2 acid groups is 1-hydroxyethane-1,1-di-phosphonic acid:

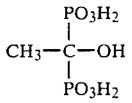

An example of a nitrogenous phosphonic acid with 3 acid groups is amino-tri-(methylene phosphonic acid)

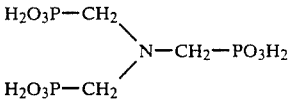

An example of a nitrogenous phosphonic acid with 4 acid groups is ethylene diamine-tetra-methylene phosphonic acid

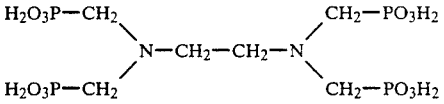

An example of a nitrogenous phosphonic acid with 5 acid groups is diethylene-triamine-penta-methylene phosphonic acid

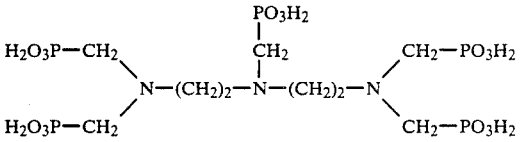

Bismuth can be used e.g. as ammonium bismuth citrate; however, all other water-soluble bismuth compounds can also be used.

The optimum bismuth concentration depends on the phosphonic acid used or, if a pure phosphate bath is used, on it. The optimum bismuth can be determined by test experiments. The required amount of bismuth increases with the number of $—PO_3H_2$ groups on the phosphonic acid.

DETAILED DESCRIPTION OF PREFERRED EMBODIMENTS

The following examples are intended to illustrate the baths of the invention in more detail:

1. A gold electrolyte in the form of an aqueous solution consisting of the following components is prepared:

| | |
|---|---|
| 18 g/l $KAu(CN)_2$ | (=12 g/l Au) |
| 100 g/l $K_2HPO_4$ | |
| 6 mg/l ammonium bismuth citrate | (=3 mg/l Bi). |

After adjustment of the pH to 8.0 and of the bath temperature to 70° C., yellow, satin-finished coatings with good bondability are obtained with direct current at a current density of 0.5–3 A/dm$^2$ and a substrate motion of 5 cm/sec.

The same bath furnishes similar coatings on a spray cell (jet plating) at a current density range of 0.5 to 15 A/dm$^2$.

The gold coatings produced in this manner can be used well for the intended bonding applications; however, they are somewhat inhomogeneous and slightly spotted in their surface finish.

If the bismuth is omitted from the bath, then only brown, dull coatings which are useless for bonding are obtained at a substrate motion of 5 cm/sec. and current densities above 0.5 A/dm$^2$ and in a spray cell at current densities above 2 A/dm$^2$.

2. A gold electrolyte in the form of an aqueous solution consisting of the following components is prepared:

| | |
|---|---|
| 18 g/l $KAu(CN)_2$ | (=12 g/l Au) |
| 5 g/l 1-hydroxyethane-1,1-di-phosphonic acid | |
| KOH sufficient to achieve a pH of 7.5 | |
| 2 mg/l ammonium bismuth citrate | (1 mg/l Bi). |

Yellow, satin-finished coatings with good bondability are obtained using direct current with current densities of 0.5–3 A/dm$^2$ at a substrate motion of 5 cm/sec. and a bath temperature of 70° C.

The same bath furnishes similar coatings in a current density range of 0.5–20 A/dm$^2$ after raising the gold content to 16 g/l, in a spray cell (jet plating).

3. A gold electrolyte in the form of an aqueous solution consisting of the following components is prepared:

| | |
|---|---|
| 24 g/l $KAu(CN)_2$ | (=16 g/l Au) |
| 100 g/l ethylene diamine-tetra-methylene phosphonic acid | |
| KOH sufficient for a pH of 8.0 | |
| and 6 g/l ammonium bismuth citrate | (3 g/l Bi). |

The coatings obtained with this bath under the same working conditions as in Example 2 correspond in appearance and behavior to those of Example 2.

4. A basic electrolyte bath is made up which contains the following:

| | |
|---|---|
| 18 g/l $KAu(CN)_2$ | (=12 g/l Au) and |
| 100 g/l $K_2HPO_4$. | |

Then one of the following is added to it:

a. 60 g/l 1-hydroxyethane-1,1-di-phosphonic acid and 10 mg/l ammonium bismuth citrate (5 mg/l Bi) or
b. 60 g/l amino-tri-methylene phosphonic acid and 15 mg/l ammonium bismuth citrate (7.5 mg/l Bi) or
c. 60 g/l hexasodium salt of ethylene diamine-tetramethylene phosphonic acid and 1.5 g/l ammonium bismuth citrate (0.75 g/l Bi) or
d. 100 g/l ethylenediamine-tetra-methylene phosphonic acid and 6 g/l ammonium bismuth citrate (3 g/l Bi)

The pH of these baths is subsequently adjusted with KOH to 8.0 and the temperature to 70° C.

All baths furnish yellow, satin-finished coatings which are very uniform in their surface finish under conventional plating conditions, that is, with slight electrolyte motion and a substrate motion of approximately 5 cm/sec., with unpulsed direct current in a current density range of 0.5–3 A/dm$^2$ or in spray cells in a current density range of 0.5–25 A/dm$^2$.

The coatings prepared from these baths exhibited a hardness of 70–110 HV (Vickers). The bismuth content was less than 0.005% (50 ppm). 0.5 μm thick gold coatings on a nickel base exhibited no discoloration of any kind after an aging of 5 minutes at 500° C. in air. The bondability in an ultrasound method with aluminum wire 300 μm thick was unobjectionable and no wire tears were observed in a traction test up to over 500 cN. It was found after an aging of the bonded specimens for 48 hours at 150° C. in air that the bond strength did not exhibit the slightest decrease.

What is claimed is:

1. A bath for the electrolytic deposition of bondable fine gold coatings having a gold content above 99.99% by weight, containing a) gold as alkali or ammonium gold-(I)-cyanide
b) phosphonic acid compounds selected from the class consisting of phosphonic acids and their salts and derivatives,
c) a water-soluble bismuth compound, said bath containing 2 to 100 g/l gold, 0.1 mg to 5 g/l bismuth, 5 to 250 g/l phosphonic acid compound and having a pH of 6 to 10.

2. A bath according to claim 1 which contains at least one phosphonic acid compound which comprises at least two groups of the form $—PO(OH)_2$, connected to an aliphatic simple or branched hydrocarbon chain which can also be interrupted by one or more nitrogen atoms.

3. A bath according to claim 1 or 2 which contains 2 to 50 g/l gold as alkali or ammonium gold (I)-cyanide, 5 to 250 g/l of a phosphonic acid in the form of 1-hydroxyethane-1,1-diphosphonic acid, amino-tri-methylene phosphonic acid, ethylene diamine-tetra-methylene phosphonic acid or a hexasodium salt of this acid and 0.5 mg to 4 g/l bismuth in the form of ammonium bismuth citrate.

4. A bath according to claim 1 or claim 2 which contains 8 to 24 g/l gold, 20 to 120 g/l phosphonic acid and 0.5 to 4000 mg/l bismuth.

* * * * *